US006536102B1

(12) United States Patent
Heuterman

(10) Patent No.: US 6,536,102 B1
(45) Date of Patent: Mar. 25, 2003

(54) APPARATUS FOR ATTACHING A SUBSTANTIALLY FLAT CARRIER STRAP TO AN OBJECT

(75) Inventor: Willem H. Heuterman, Zutphen (NL)

(73) Assignee: Visser's -Gravendeel Holding B.V. (NL)

( * ) Notice: Subject to any disclaimer, the term of this patent is extended or adjusted under 35 U.S.C. 154(b) by 0 days.

(21) Appl. No.: 09/762,632

(22) PCT Filed: Jul. 22, 1999

(86) PCT No.: PCT/NL99/00473

§ 371 (c)(1),
(2), (4) Date: Apr. 28, 2001

(87) PCT Pub. No.: WO00/09400

PCT Pub. Date: Feb. 24, 2000

(30) Foreign Application Priority Data

Aug. 12, 1998 (NL) ..... 1009849

(51) Int. Cl.[7] ..... B23P 21/00; B65B 61/20

(52) U.S. Cl. ..... 29/774; 29/789; 29/453; 53/134.1

(58) Field of Search ..... 29/771, 772, 773, 29/789, 809, 453, 774; 53/413, 134.1

(56) References Cited

U.S. PATENT DOCUMENTS 3,818,572 A 6/1974 Burell
4,784,265 A * 11/1988 Gitlitz et al. ..... 53/413
5,095,683 A * 3/1992 Roberts et al. ..... 53/413
5,199,243 A * 4/1993 Vlasaty et al. ..... 53/413
6,014,850 A * 1/2000 LeMire ..... 53/134.1
6,176,002 B1 * 1/2001 Korb ..... 29/453

FOREIGN PATENT DOCUMENTS

GB 2 318 322 A 4/1998

* cited by examiner

*Primary Examiner*—David P. Bryant
(74) *Attorney, Agent, or Firm*—Banner & Witcoff, Ltd.

(57) ABSTRACT

The invention relates to an apparatus for attaching to an object a substantially flat carrier strap which is intended to engage by means of locking members arranged on each end into an elongate slot in the object, wherein the slots are arranged substantially mutually in line in the object and wherein the apparatus comprises: engaging means for engaging a straightened carrier strap in the proximity of both ends; first rotation means for causing the engaging means to rotate into a position in which the ends of the carrier strap are directed substantially vertically; second rotation means for causing the engaging means to rotate into a position in which the ends of the carrier strap lie substantially in the same plane; and translation means for causing the ends of the strap to each move downward in substantially vertical direction into the slot to a depth such that the locking members grip in the slot.

15 Claims, 6 Drawing Sheets

APPARATUS FOR ATTACHING A SUBSTANTIALLY FLAT CARRIER STRAP TO AN OBJECT

FIELD OF THE INVENTION

The present invention relates to an apparatus for attaching a substantially flat carrier strap to an object.

BACKGROUND OF THE INVENTION

Such carrier straps are generally known and are attached for instance to trays with plants or baskets with fruit or vegetables. Such carrier straps have heretofore been arranged by hand. It will be apparent that this is time-consuming and thus costly work.

There is therefore a need for an apparatus which performs these operations in automated manner.

BRIEF DESCRIPTION OF THE INVENTION

The present invention provides for this purpose an apparatus for attaching to an object a substantially flat carrier strap which is intended to engage by means of locking members arranged on each end into an elongate slot in the object, wherein the slots are arranged substantially mutually in line in the object and wherein the apparatus comprises:

- engaging means for engaging a straightened carrier strap in the proximity of both ends;
- first rotation means for causing the engaging means to rotate into a position in which the ends of the carrier strap are directed substantially vertically;
- second rotation means for causing the engaging means to rotate into a position in which the ends of the carrier strap lie substantially in the same plane; and
- translation means for causing the ends of the strap to each move downward in substantially vertical direction into the slot to a depth such that the locking members grip in the slot.

It is pointed out here that the slots in such a tray or such a basket are generally arranged mutually in line. The straps are therefore provided with a thinned portion so that at the position of the slot the strap can extend in the transverse direction of the slot. The slot is however made with a determined length in order to move the ends of the strap with the locking members fixed thereto through the slot, wherein after the strap is released it will spring back to its natural position and the locking members engage on the slot or the part of the object lying thereunder, wherein the thin portion of the strap is located in the slot.

Starting from a completely straightened strap extending parallel to the upper surface of the object, and therefore parallel to the slots, the ends of the strap must first be moved downward, whereby the strap acquires a substantially U-shaped configuration, wherein the ends of the strap extend transversely of the slot direction.

In order to place the strap through the slots each end of the strap must be turned through a vertical axis and the ends must be moved downward.

The present invention provides an apparatus for performing these operations.

According to a preferred embodiment the first rotation means are coupled directly to a drive device and the second rotation means are coupled to the first rotation means by a bevel gear.

This measure results in a considerable simplification of the drive device since a separate drive is not required for the second rotation means.

According to another preferred embodiment the engaging means comprise two bodies, each of which is provided with a groove, which groove is adapted to engage the ends of the strap, wherein each of the bodies is provided with a ball under spring pressure for fixedly clamping the strap.

This construction provides the option of temporarily clamping the strap in a firm manner, wherein it is easy to place a strap in contact with the engaging means, and when the strap is inserted into the slots the arresting force exerted by the locking members is greater than the holding force of the engaging means so that these latter release automatically.

According to another preferred embodiment the first rotation means comprise a first shaft which extends substantially transversely of the groove direction and on which the engaging means are rotatable, which shaft is drivable by means of a lever and a linear drive device.

This results in a structurally attractive embodiment.

Similar considerations apply in respect of the measure where the second rotation means comprise a second shaft extending perpendicularly of the first shaft and mounted in a bush connected to the first shaft.

A particularly attractive embodiment results when the first shaft is mounted in a frame which is movable in vertical direction.

According to another preferred embodiment the apparatus comprises a supply holder for the carrier straps for arranging, which supply holder is adapted to contain the carrier straps in substantially horizontal direction, in addition to an individualizing device for removing the carrier straps on the underside of the supply holder and feeding the carrier straps to the engaging device.

Other attractive preferred embodiments are stated in the remaining sub-claims.

BRIEF DESCRIPTION OF THE DRAWINGS

The present invention will be elucidated hereinbelow with reference to the annexed drawings, in which.

DETAILED DESCRIPTION OF THE INVENTION

Figure 1:
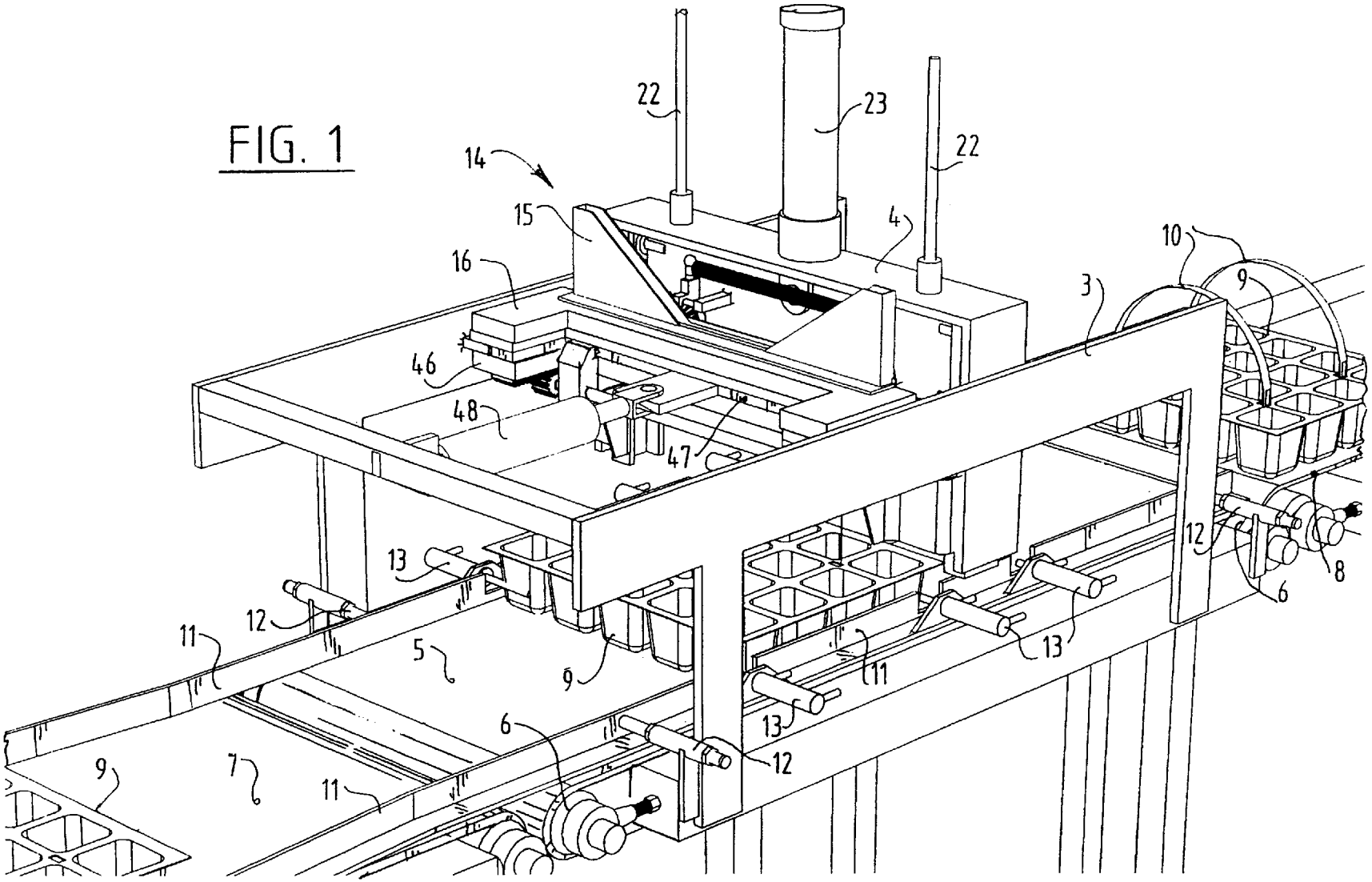
FIG. 1 shows a perspective view of an apparatus according to the invention.

The apparatus according to the present invention essentially comprises a support frame 1 on which is placed a transporting device 2. An auxiliary frame 3 is further arranged on top of support frame 1, in addition to a bridge frame 4. The transporting device is formed by a conveyor belt 5 which is trained around rollers 6 arranged on support frame 1, at least one of which rollers is driven in a manner not shown in the drawing. The drive device further comprises a feed belt 7 for feeding and an outfeed belt 8 for discharging the trays 9 which must be provided with carrier straps 10. Guides 11 are further arranged for guiding trays 9.

Guides 11 are adjustable by means of adjusting pins which are controlled automatically or otherwise.

Stop elements 13 are further arranged to cause tray 9 to stop when a strap has to be arranged. The two final stop elements 13 are intended to stop tray 9 in the two positions at which carrier straps 10 have to be arranged, and the first stop element is arranged to hold back following trays so as to have the least possible effect on the position of the tray positioned for arranging of the carrier straps.

A supply holder 14 is arranged for storage of carrier straps 10. This is formed by two elements 15 of U-shaped cross-section which are placed with their open side toward each other on top of a plate 16 which is fixed to auxiliary frame 3. Plate 16 is partially interrupted on the underside.

Figure 2:
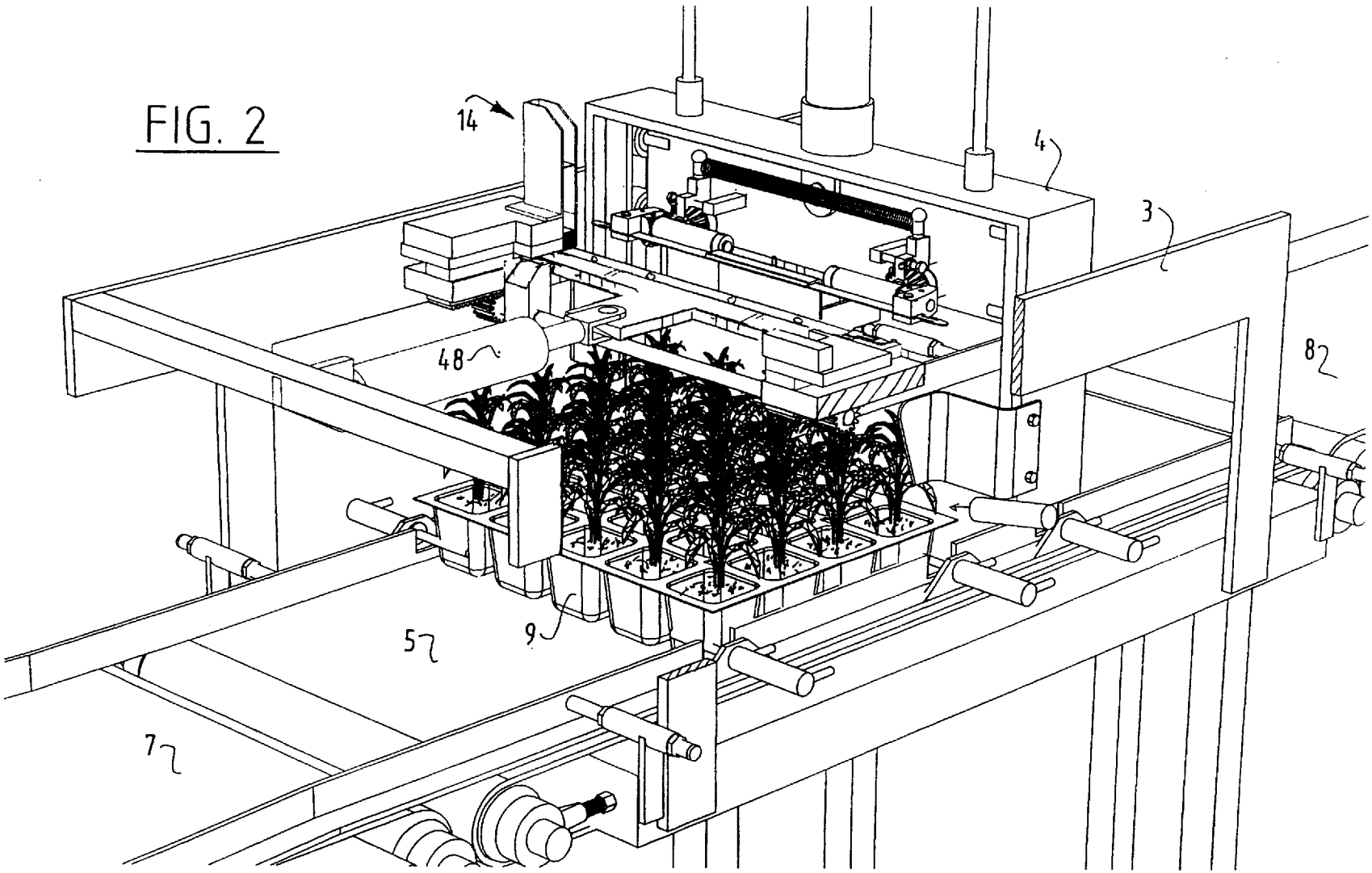
FIG. 2 shows a view corresponding with FIG. 1 wherein a number of components are broken away so as to better illustrate other components.
Figure 3:
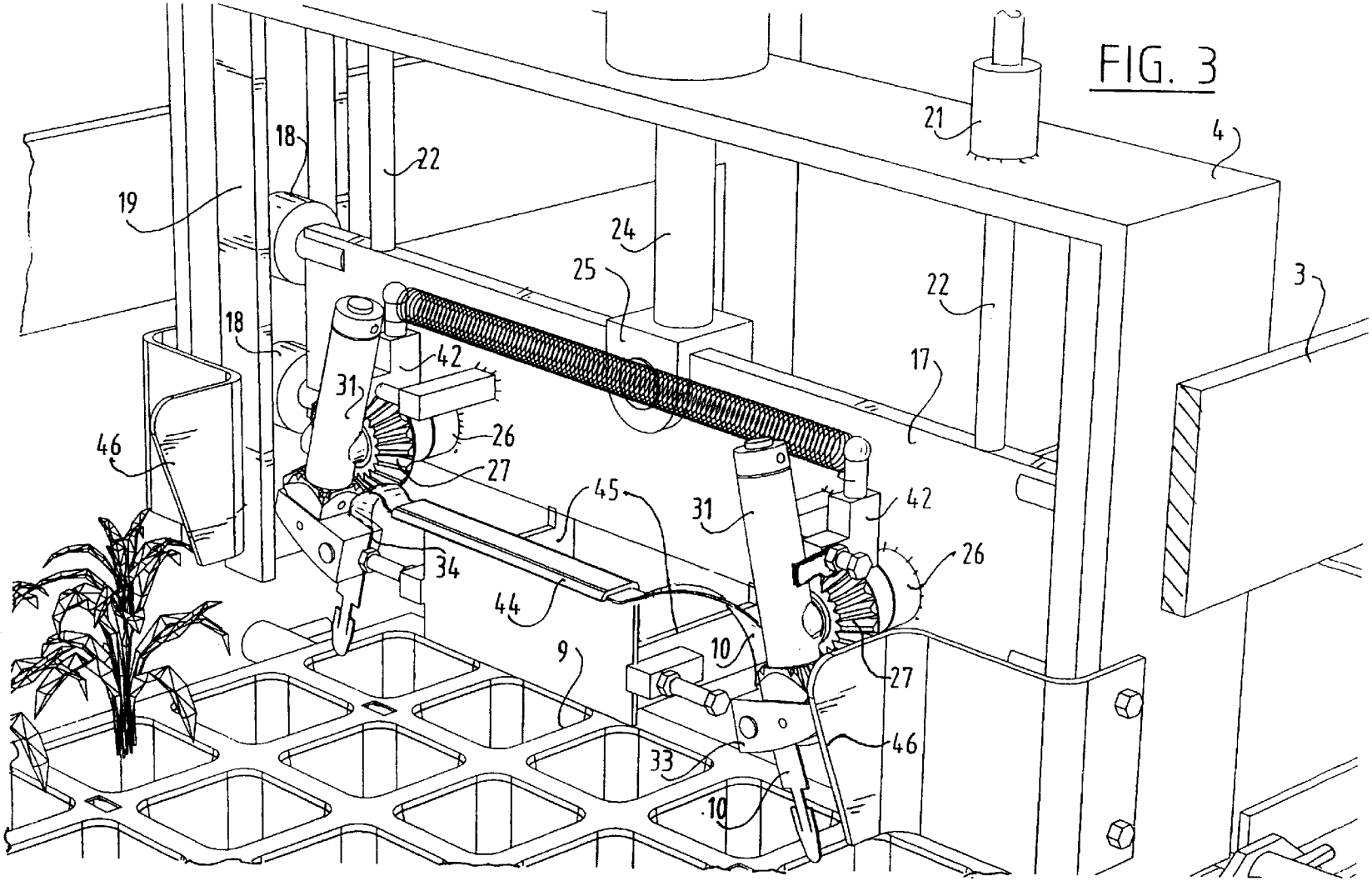
FIG. 3 is a perspective detail view of an apparatus according to the present invention.
Figure 4:
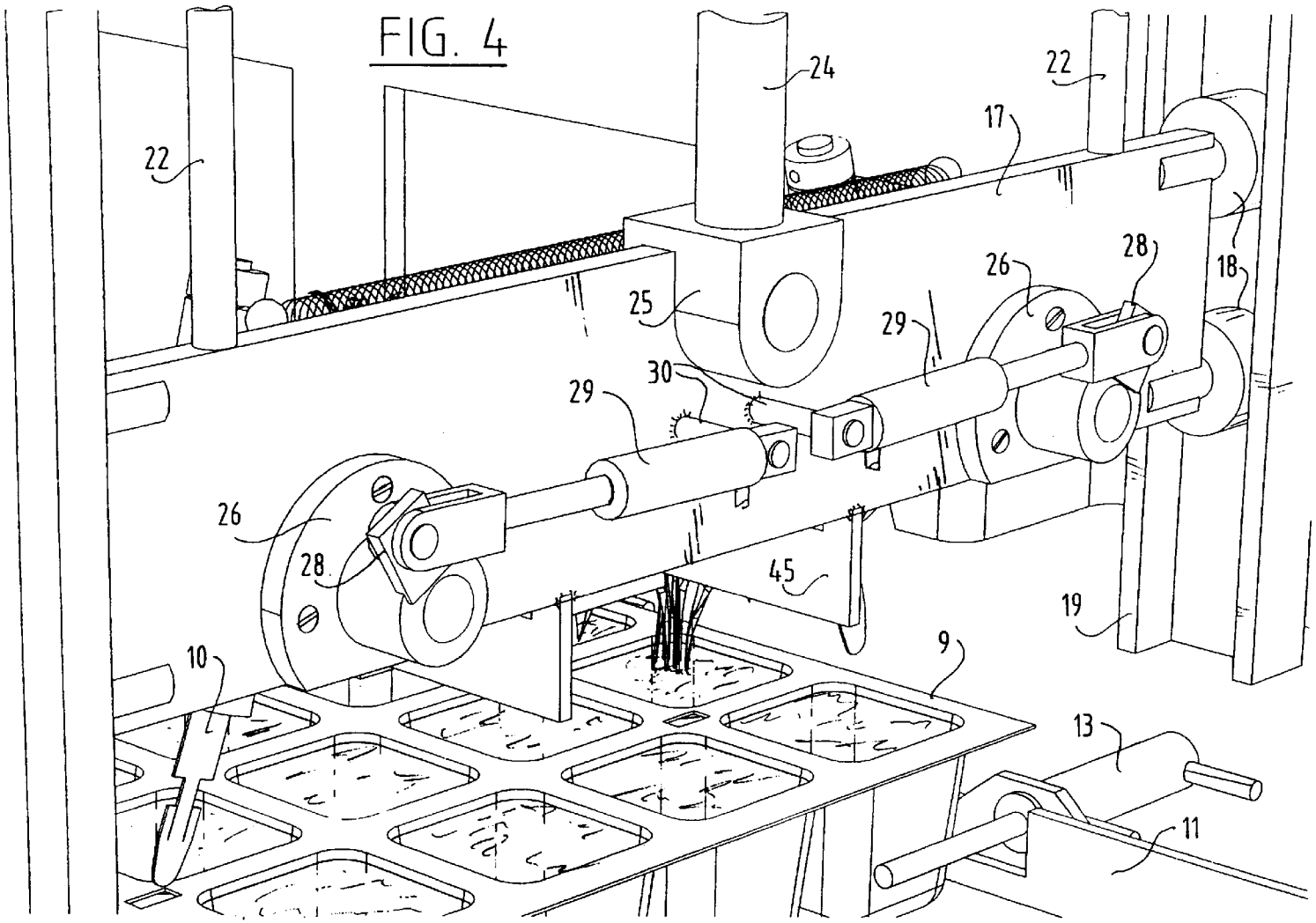
FIG. 4 is a perspective detail view of another component of the apparatus according to the invention in the position shown in FIG. 3.

The remaining components of the present invention will now be elucidated with reference to FIGS. 2 and 3.

As already set forth with reference to FIG. 1, the apparatus comprises a bridge frame 4. A plate 17 is movable in vertical direction inside bridge frame 4. For this purpose plate 17 is provided on either side with two wheels 18 which roll along against a U-shaped side part 19 of bridge frame 4. For guiding purposes, and particularly to prevent loss of alignment, guide bushes 21 are arranged on the upper part of bridge frame 4, through which bushes extend rods 22 arranged on plate 17 and which provide guiding. For driving of plate 17 in vertical direction is arranged a pneumatic cylinder 23, the piston rod 24 of which is connected to plate 17 by means of a bracket 25. In plate 17 are arranged two bushes 26 extending parallel to each other in horizontal direction transversely of plate 17. Extending through each of bushes 26 is a shaft, each of which is provided on one side with a bevel gear 27 and on the other side with a crank 28. Each of the cranks 28 is connected by means of a pneumatic cylinder 29 to a crank 30 fixed to plate 17.

Using the linear drive device it is thus possible to cause bevel gear 27 to move through a limited stroke, i.e. through an angle of about 90°. Further fixed to the shaft extending through bush 26 is a bush 31, the axis of which extends perpendicularly of said shaft. Mounted in bush 31 is a second shaft to which a second bevel gear 32 is fixed which is in engagement with first bevel gear 27. A body 33 is further mounted fixedly on the shaft with bevel gear 32.

Figure 6:
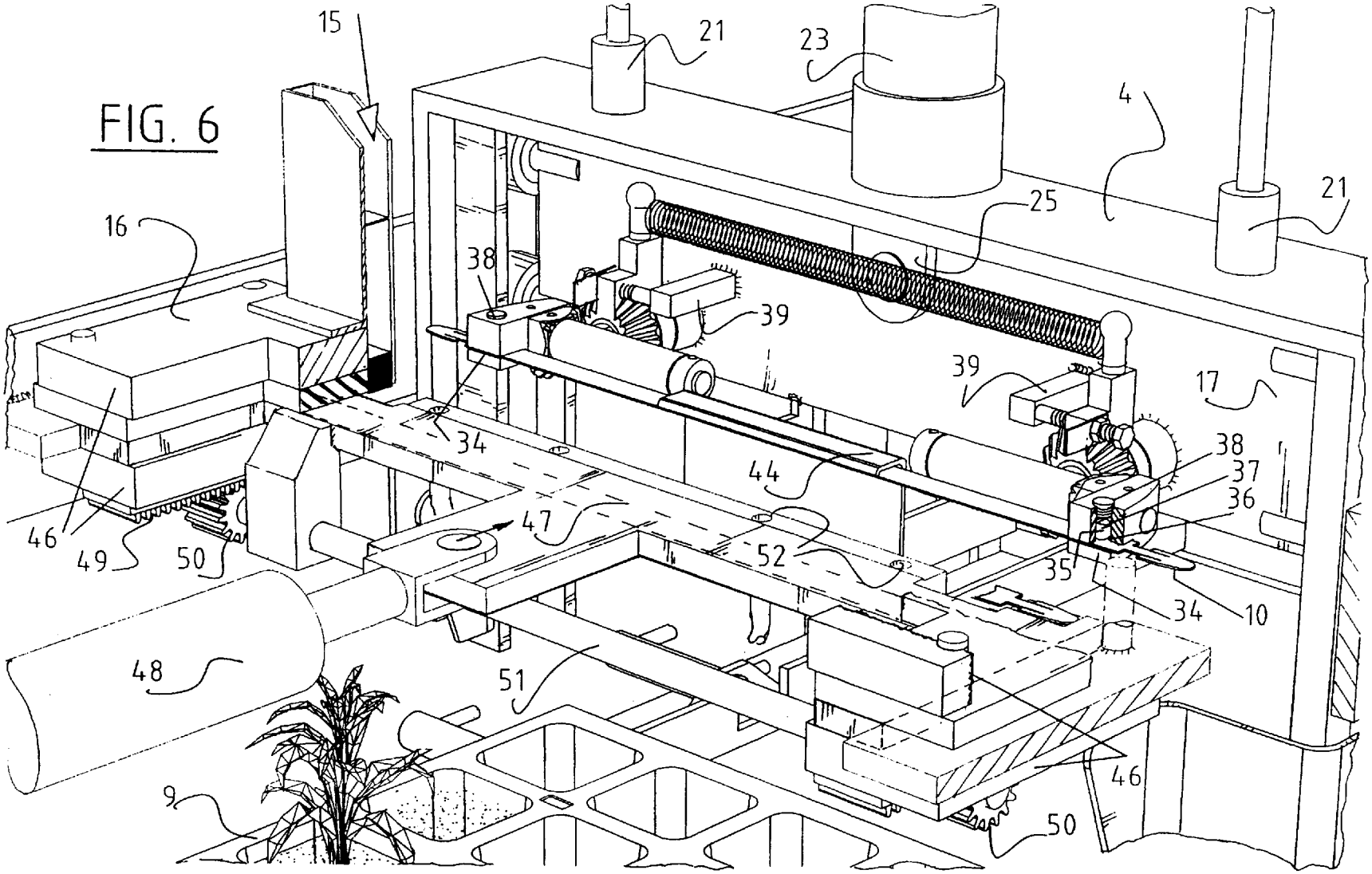
FIG. 6 is a detail view of the apparatus in yet another position.

The construction of body 33 is further shown in FIG. 6. This shows that in each of the bodies 33 a groove 34 is arranged through which the carrier strap can extend. For fixation of the end of carrier strap 10 in body 33 use is made of a ball 35 arranged in a bore 36 in which a spring 37 and a screw 38 are also situated.

A number of elements are further arranged to limit the movement of the diverse components. Two stops 39 and adjustable elements 41 are thus arranged on plate 17, while on the first bevel gear 27 are arranged levers 42 which are mutually connected by a spring 43.

In order to prevent the carrier strap disrupting the movement of the diverse components, a limiting bracket 44 is arranged which is connected to plate 17 by means of a set of levers 45. Finally, two guides 46 are arranged which, should the tip of carrier strap 10 not be placed successfully, prevent the then detached carrier strap from impeding the operation of the diverse elements.

Finally, the mechanism which ensures that the carrier straps are guided into slots 34 is also discussed. As shown in FIG. 1, a plate 16 on which supply holder 14 is placed is arranged in auxiliary frame 3. A plate 46 is arranged under plate 16 with some interspacing, wherein a slide element 47 is arranged slidably between the plates. Slide element 47 is linearly drivable by means of a pneumatic cylinder 48. Slide element 47 can be moved in horizontal direction by means of the pneumatic cylinder. In order to improve the guiding, slide element 47 is provided on its underside with gear racks 49 which are coupled by means of toothed wheels 50 arranged on the same shaft 51. The guiding is hereby improved. Slide element 47 is provided on its front side with a number of suction cups 52 which are connected to a vacuum pump by means of a system of hoses (not shown).

Now that all the components of the apparatus have been elucidated, the operation of the apparatus will be described.

A series of carrier straps 10 are initially placed in supply holder 14 and transporting devices 7, 5, 8 are switched on so that trays 9 are supplied. The middle stop member 13 is herein switched on so that a tray 9 comes to a stop in the position shown in FIG. 1.

As shown in FIG. 6, pick-up element 47 will then attach itself by suction on the underside to the bottom element in the series of carrier straps 10 received in supply holder 14 and thus cause this element to move in the direction of the arrow to the position shown in FIG. 6. Carrier strap 10 is herein enclosed in the two bodies 33 in the proximity of the relevant ends of carrier strap 10, wherein carrier strap 10 extends in grooves 34. Fixation in grooves 34 takes place by means of the spring force of spring 37 which presses ball 35 downward. The vacuum is then switched off so that the fixation between carrier strap 10 and the element 47 is released, whereafter element 47 can be moved back.

Figure 5:
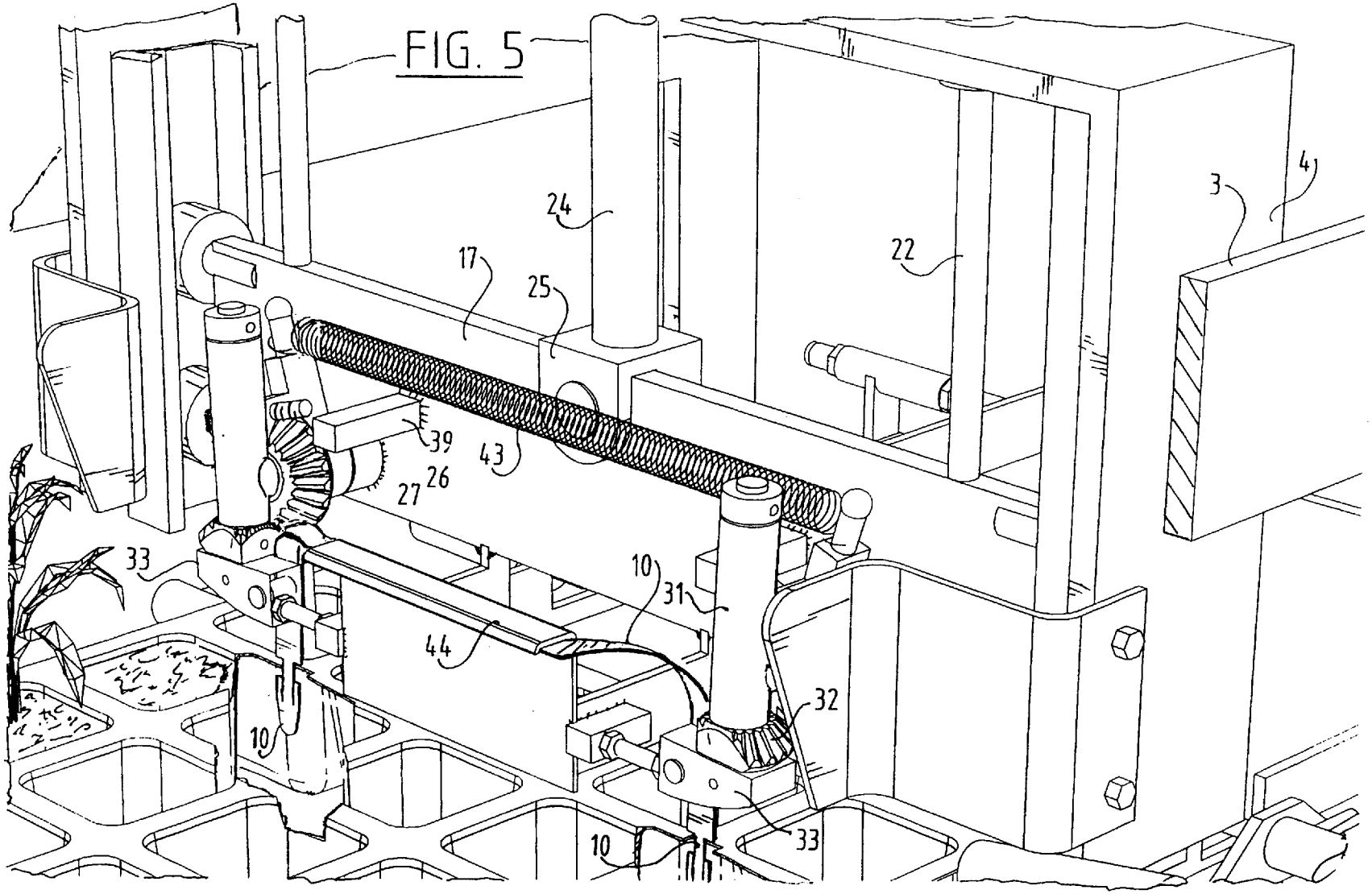
FIG. 5 shows a detail view corresponding with FIG. 3 of the present invention in a further advanced position.

The situation is then obtained as shown in FIG. 6. Both cylinders 29 are then energized, whereby the shafts extending through the bevel gears are driven together with the bushes 31 fixed thereon and bodies 33. These will hereby be displaced from the position shown in FIG. 6 to the position shown in FIG. 3. As a consequence of the action of the mutually engaging bevel gears 27, 32, wherein bevel gear 27 is mounted fixedly on plate 17, the shaft extending through bush 31 will also rotate on its own axis. It is important here that the rotation on the horizontal axis is prevented by stop element 42. Further rotation of the horizontal shaft thus results in a further rotation of the now almost vertical shaft, whereby the strap comes to lie such that it can be placed in the slot, as shown in FIG. 5. Cylinder 29 is then moved in reverse direction, wherein strap 10 is once again turned through about 90° at its end. The locking members arranged on the ends of the straps will herein grip behind the slot so that the strap can no longer be retracted. When plate 17 is then moved upward once again, the strap will therefore remain in place, wherein the strap is released by the bodies as a result of the spring action. The movements herein proceed in reverse sequence.

The middle stop element 13 is then switched off and the following switched on, so that the tray moves one position further. Following slotted holes arranged in the tray are herein positioned correctly for arranging the following strap.

The stated cycle is herein repeated. It will be apparent that although the embodiment in question relates to a tray provided with two carrier straps, the invention is equally applicable in the case of trays provided with a single carrier strap or other types of element such as baskets for fruit and so on.

It will further be apparent that diverse modifications can be made to the described embodiment without departing from the present invention.

What is claimed is:

1. An apparatus for attaching a substantially flat carrier strap to an object wherein the strap has a locking member on each end, each locking member being able to engage an elongate slot in the object, wherein the object is arranged in the apparatus such that the slots in the object are arranged substantially mutually in line, the apparatus comprising:

engaging means for engaging the flat carrier strap in the proximity of each end of the strap;

first rotation means coupled directly to a drive device for causing the engaging means to rotate into a position in which the ends of the carrier strap are directed substantially vertically;

second rotation means coupled to the first rotation means by a pair of bevel gears for causing the engaging means to rotate into a position in which the ends of the carrier strap lie substantially in the same plane;

translation means for causing each of the ends of the strap to move downward in substantially vertical direction into the slot to a depth such that the locking members grip the slot.

2. Apparatus as claimed in claim 1 wherein the engaging means comprise two bodies, each body having a groove which can engage an end of the strap and each body having a ball under spring pressure for fixedly clamping the strap.

3. Apparatus as claimed in claim 2 wherein the first rotation means comprise a first shaft extending substantially transversely of the groove direction and on which the engaging means are rotatable, wherein the shaft is drivable by means of a lever and a linear drive device.

4. Apparatus as claimed in claim 2 wherein the second rotation means comprise a second shaft extending perpendicularly of the first shaft and mounted in a bush connected to the first shaft.

5. Apparatus as claimed in claim 2 further comprising a supply holder for the carrier strap, wherein the supply holder holds the carrier strap in a substantially horizontal direction, and wherein the supply holder comprises a device to remove a single carrier strap from the underside of the supply holder and to feed the carrier strap to the engaging device.

6. Apparatus as claimed in claim 2 further comprising a transporting device for intermittent feed and removal of each object.

7. Apparatus as claimed in claim 1 wherein the first rotation means comprise a first shaft which extends substantially transversely of the groove direction and on which the engaging means are rotatable, which shaft is drivable by means of a lever and a linear drive device.

8. Apparatus as claimed in claim 7 wherein the first shaft is mounted in a frame, wherein the frame is movable in vertical direction.

9. Apparatus as claimed in claim 7 wherein the second rotation means comprise a second shaft extending perpendicularly of the first shaft and mounted in a bush connected to the first shaft.

10. Apparatus as claimed in claim 1 wherein the second rotation means comprise a second shaft extending perpendicularly of the first shaft and mounted in a bush connected to the first shaft.

11. Apparatus as claimed in claim 10 wherein the first shaft is mounted in a frame, wherein the frame is movable in a vertical direction.

12. Apparatus as claimed in claim 1 further comprising a supply holder for the carrier strap, wherein the supply holder holds the carrier strap in a substantially horizontal direction, and wherein the supply holder comprises a device to remove a single carrier strap from the underside of the supply holder and to feed the carrier strap to the engaging device.

13. Apparatus as claimed in claim 12 wherein the device comprises a plate movable in a substantially horizontal direction and provided with suction nozzles for fixing the carrier straps by suction on their underside.

14. Apparatus as claimed in claim 12 further comprising a transporting device for intermittent feed and removal of each object.

15. Apparatus as claimed in claim 1 further comprising a transporting device for intermittent feed and removal of each object.

* * * * *